US010704873B1

(12) United States Patent
Minica et al.

(10) Patent No.: US 10,704,873 B1
(45) Date of Patent: Jul. 7, 2020

(54) LIGHTED NOCK DEVICE

(71) Applicants: Stuart Minica, La Vernia, TX (US); Michael Austin, La Vernia, TX (US)

(72) Inventors: Stuart Minica, La Vernia, TX (US); Michael Austin, La Vernia, TX (US)

(73) Assignee: DoubleTake Archery, LLC, La Vernia, TX (US)

( * ) Notice: Subject to any disclaimer, the term of this patent is extended or adjusted under 35 U.S.C. 154(b) by 0 days.

(21) Appl. No.: 16/205,188

(22) Filed: Nov. 29, 2018

Related U.S. Application Data

(60) Provisional application No. 62/596,585, filed on Dec. 8, 2017.

(51) Int. Cl.
*F42B 6/06* (2006.01)

(52) U.S. Cl.
CPC ..... *F42B 6/06* (2013.01)

(58) Field of Classification Search
CPC ..... F42B 6/06; F42B 12/362; F42B 12/382
USPC ..... 473/578
See application file for complete search history.

(56) References Cited

U.S. PATENT DOCUMENTS 4,340,930 A * 7/1982 Carissimi ..... F21V 33/008 362/110
5,134,552 A * 7/1992 Call ..... F21L 15/00 362/109
6,123,631 A * 9/2000 Ginder ..... F42B 6/06 473/570
7,837,580 B2 * 11/2010 Huang ..... F42B 6/06 473/570
8,342,990 B1 * 1/2013 Price ..... 473/570
8,777,786 B1 * 7/2014 Bay ..... F42B 12/42 473/578
9,140,527 B2 * 9/2015 Pedersen ..... F42B 6/02
9,151,580 B2 * 10/2015 Pedersen ..... F42B 6/02
9,279,647 B2 * 3/2016 Marshall, Jr. ..... F42B 12/382
9,546,851 B2 * 1/2017 Kim ..... F42B 12/382
10,001,353 B1 * 6/2018 Godsey ..... F42B 6/06
10,094,642 B1 * 10/2018 Godsey ..... F42B 6/06
10,203,187 B1 * 2/2019 Bay ..... F42B 6/06
10,254,095 B1 * 4/2019 Wang ..... F42B 6/06
2003/0171174 A1 * 9/2003 Price ..... F42B 6/06 473/578
2009/0098960 A1 * 4/2009 Brywig ..... F21V 33/008 473/578

(Continued)

*Primary Examiner* — Alexander R Niconovich
(74) *Attorney, Agent, or Firm* — Taboada Law Firm, PLLC; John M. Taboada

(57) ABSTRACT

Methods and systems for illuminating an arrow nock or bolt end are disclosed, including providing a lighted nock having: a nock body which has a portion for attachment to an arrow or shaft and a slotted proximate end adapted to receive a bowstring; and a detent member, a luminous assembly, and a push member all of which are at least partially disposed within the nock body, wherein the push member comprises a recess and at least a portion of the push member protrudes into the proximate end; attaching the lighted nock to the bowstring, thereby releasing the portion of the detent member from within the recess of the push member; drawing the bowstring; and releasing the bowstring, thereby withdrawing the bowstring from the slot, and illuminating the nock. Other embodiments are described and claimed.

26 Claims, 11 Drawing Sheets

(56) References Cited

U.S. PATENT DOCUMENTS

| | | | | |
|---|---|---|---|---|
| 2012/0100942 | A1* | 4/2012 | Minica | F42B 6/06 473/570 |
| 2013/0267359 | A1* | 10/2013 | Pedersen | F42B 6/06 473/570 |
| 2014/0187362 | A1* | 7/2014 | Pedersen | F42B 12/382 473/570 |
| 2015/0192395 | A1* | 7/2015 | Beck | F42B 6/06 473/570 |
| 2018/0188010 | A1* | 7/2018 | Bay | F42B 6/06 |
| 2018/0231356 | A1* | 8/2018 | Yehle | F42B 6/06 |

* cited by examiner

LIGHTED NOCK DEVICE

I. CROSS REFERENCE TO RELATED APPLICATIONS

This application claims the benefit of the filing date of U.S. Provisional Patent Application Ser. No. 62/596,585, filed on Dec. 8, 2017, entitled "Lighted Nock Device," the entire disclosure of which is hereby incorporated by reference into the present disclosure.

II. BACKGROUND

The invention relates generally to the field of archery and the problem of being able to see an arrow in flight, being able to see the point of arrow impact, and most importantly, finding an arrow after the shot. More specifically, this invention relates to a lighted nock device having a luminous assembly and an integrated detent member.

III. SUMMARY

In one respect, disclosed is a lighted nock comprising: a nock body comprising: an arrow or shaft attachment portion; and a proximate end having a slot adapted to receive a bowstring; a detent member at least partially disposed within the nock body; a luminous assembly at least partially disposed within the nock body; and a push member at least partially disposed within the nock body, wherein the push member comprises a recess and at least a portion of the push member protrudes into the proximate end.

In another respect, disclosed is a lighted nock comprising: a nock body comprising: an arrow or shaft attachment portion; and a proximate end having a slot adapted to receive a bowstring; a detent member at least partially disposed within the nock body; and a luminous assembly at least partially disposed within the nock body, wherein the luminous assembly comprises: a power source; and a light source; wherein the light source comprises a recess and at least a portion of the light source protrudes into the proximate end.

In one respect, disclosed is a method for illuminating a nock, comprising: providing a nock having: a nock body comprising: an arrow or shaft attachment portion; and a proximate end having a slot adapted to receive a bowstring; a detent member at least partially disposed within the nock body; a luminous assembly at least partially disposed within the nock body; and a push member at least partially disposed within the nock body, wherein the push member comprises a recess and at least a portion of the push member protrudes into the proximate end; attaching the nock to the bowstring, thereby releasing the portion of the detent member from within the recess of the push member; drawing the bowstring; and releasing the bowstring, thereby withdrawing the bowstring from the slot, and illuminating the nock.

In another respect, disclosed is a method for illuminating a nock, comprising: providing a nock having: a nock body comprising: an arrow or shaft attachment portion; and a proximate end having a slot adapted to receive a bowstring; a detent member at least partially disposed within the nock body; and a luminous assembly at least partially disposed within the nock body, wherein the luminous assembly comprises: a power source; and a light source; wherein the light source comprises a recess and at least a portion of the light source protrudes into the proximate end; attaching the nock to the bowstring, thereby releasing the portion of the detent member from within the recess of the light source; drawing the bowstring; and releasing the bowstring, thereby withdrawing the bowstring from the slot, and illuminating the nock.

In one respect, disclosed is a lighted bolt end comprising: a bolt end body comprising: a bolt or shaft attachment portion; and a proximate end adapted to abut a bowstring; a detent member at least partially disposed within the bolt end body; a luminous assembly at least partially disposed within the bolt end body; and a push member at least partially disposed within the bolt end body, wherein the push member comprises a recess and at least a portion of the push member protrudes from the proximate end.

In another respect, disclosed is a lighted bolt end comprising: a bolt end body comprising: a bolt or shaft attachment portion; and a proximate end adapted to abut a bowstring; a detent member at least partially disposed within the bolt end body; and a luminous assembly at least partially disposed within the bolt end body, wherein the luminous assembly comprises: a power source; and a light source; wherein the light source comprises a recess and at least a portion of the light source protrudes from the proximate end.

In one respect, disclosed is a method for illuminating a bolt end, comprising: providing a bolt end having: a bolt end body comprising: a bolt or shaft attachment portion; and a proximate end adapted to abut a bowstring; a detent member at least partially disposed within the bolt end body; a luminous assembly at least partially disposed within the bolt end body; and a push member at least partially disposed within the bolt end body, wherein the push member comprises a recess and at least a portion of the push member protrudes though the proximate end; loading the bolt end into a barrel of a crossbow thereby pressing the portion of the push member protruding through the proximate end of the bolt end body to the bowstring and releasing the portion of the detent member from within the recess of the push member; and firing the crossbow; thereby separating the bolt end from the bowstring, and illuminating the nock.

In another respect, disclosed is a method for illuminating a bolt end, comprising: providing a bolt end having: a bolt end body comprising: a bolt or shaft attachment portion; and a proximate end adapted to abut a bowstring; a detent member at least partially disposed within the bolt end body; and a luminous assembly at least partially disposed within the bolt end body, wherein the luminous assembly comprises: a power source; and a light source; and wherein the light source comprises a recess and at least a portion of the light source protrudes through the proximate end; loading the bolt end into a barrel of a crossbow thereby pressing the portion of the light source protruding through the proximate end of the bolt end body to the bowstring and releasing the portion of the detent member from within the recess of the light source; and firing the crossbow; thereby separating the bolt end from the bowstring, and illuminating the nock.

Numerous additional embodiments are also possible.

IV. BRIEF DESCRIPTION OF THE DRAWINGS

Other objects and advantages of the invention may become apparent upon reading the detailed description and upon reference to the accompanying drawings.

Figure 5:
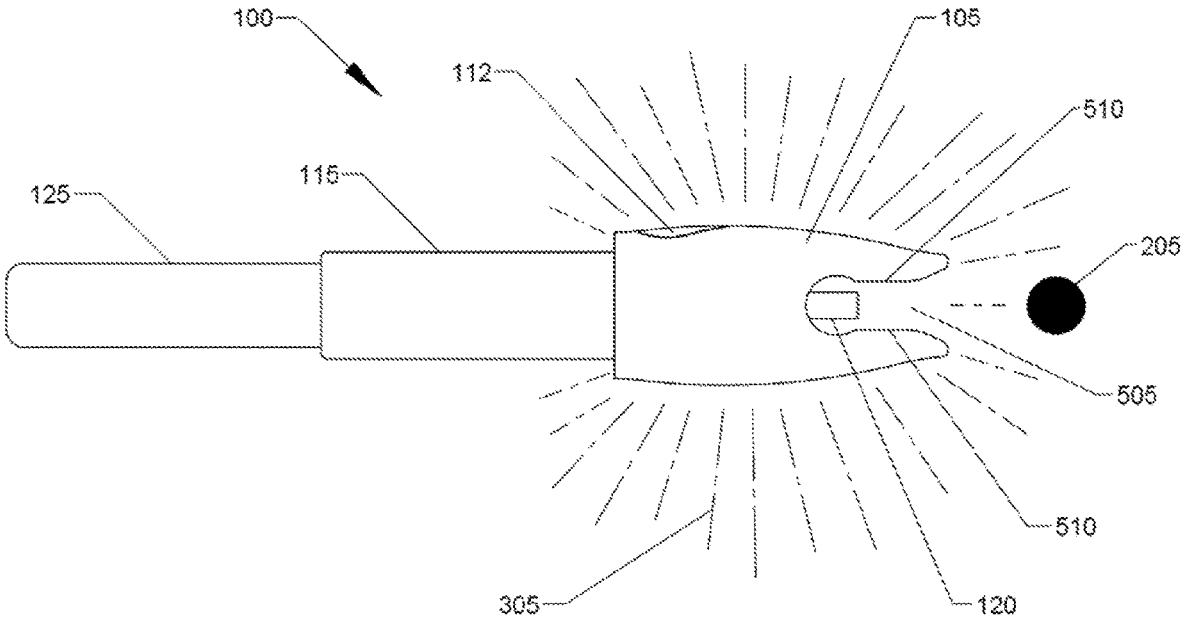
FIG. 5 is a top perspective of a lighted nock device in the "On" illuminated state, in accordance with some embodiments.
Figure 6A:
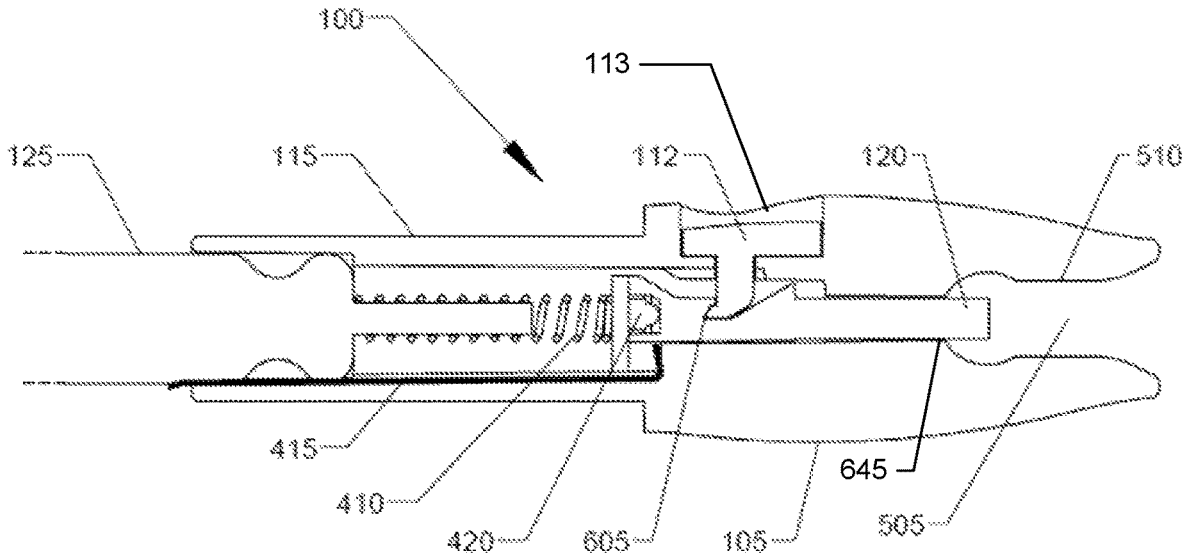
Figure 6B:
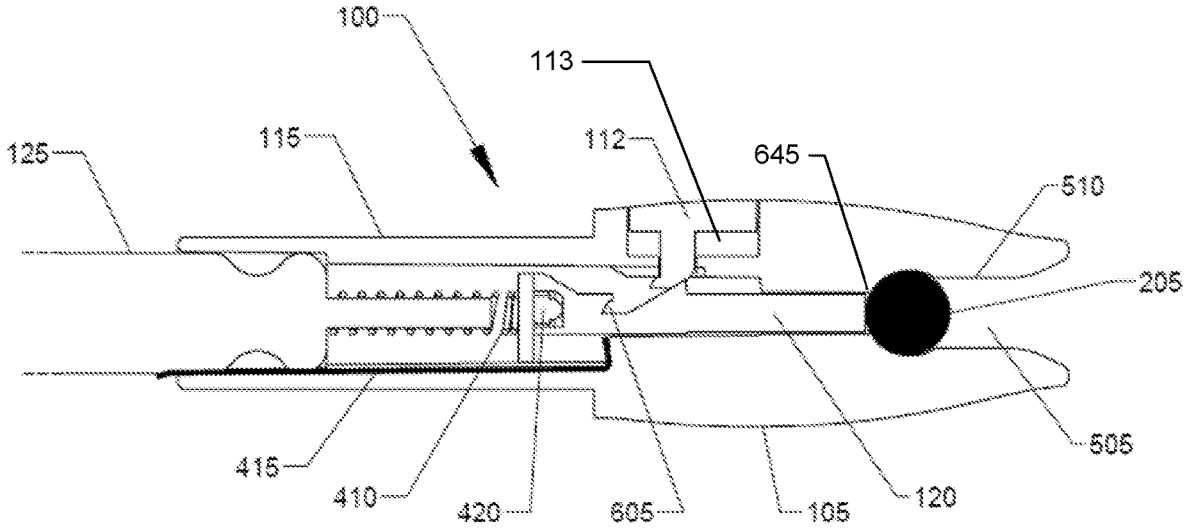
Figure 6C:
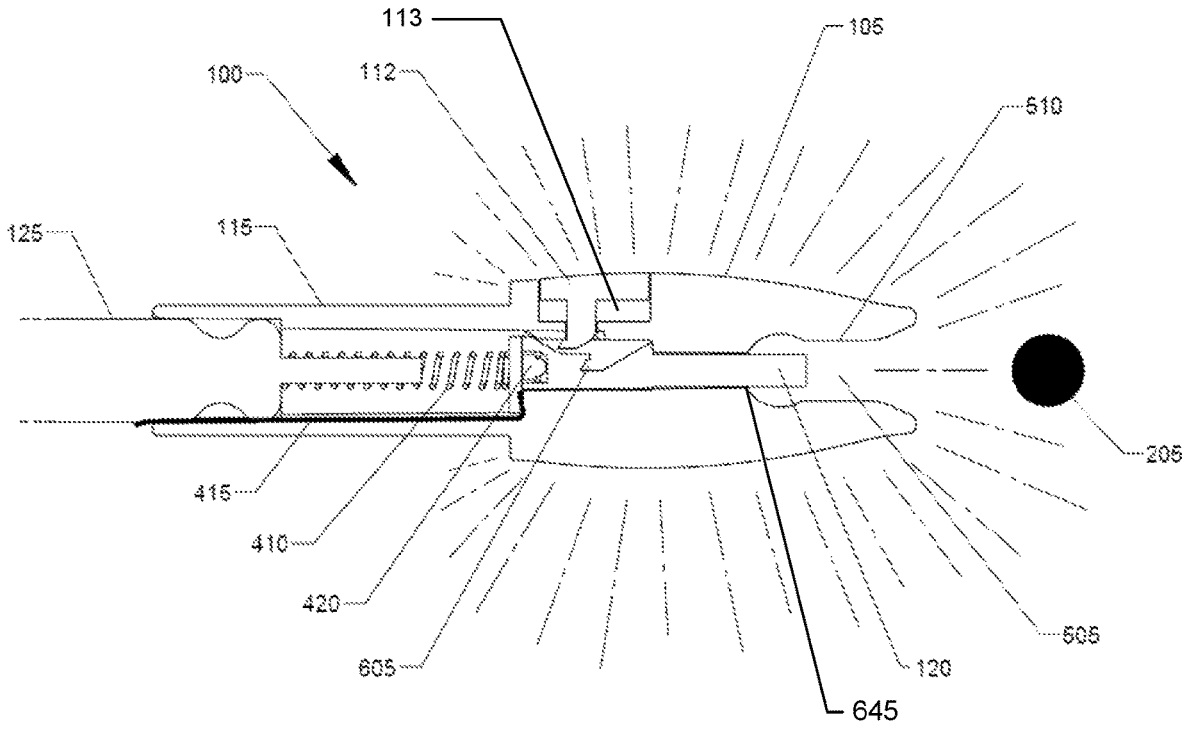

FIG. 6A, FIG. 6B, and FIG. 6C are cross-sectional, side perspectives of the lighted nock device of FIG. 5 in the "Off," nocked, and "On" states, respectively, in accordance with some embodiments.

Figure 7:
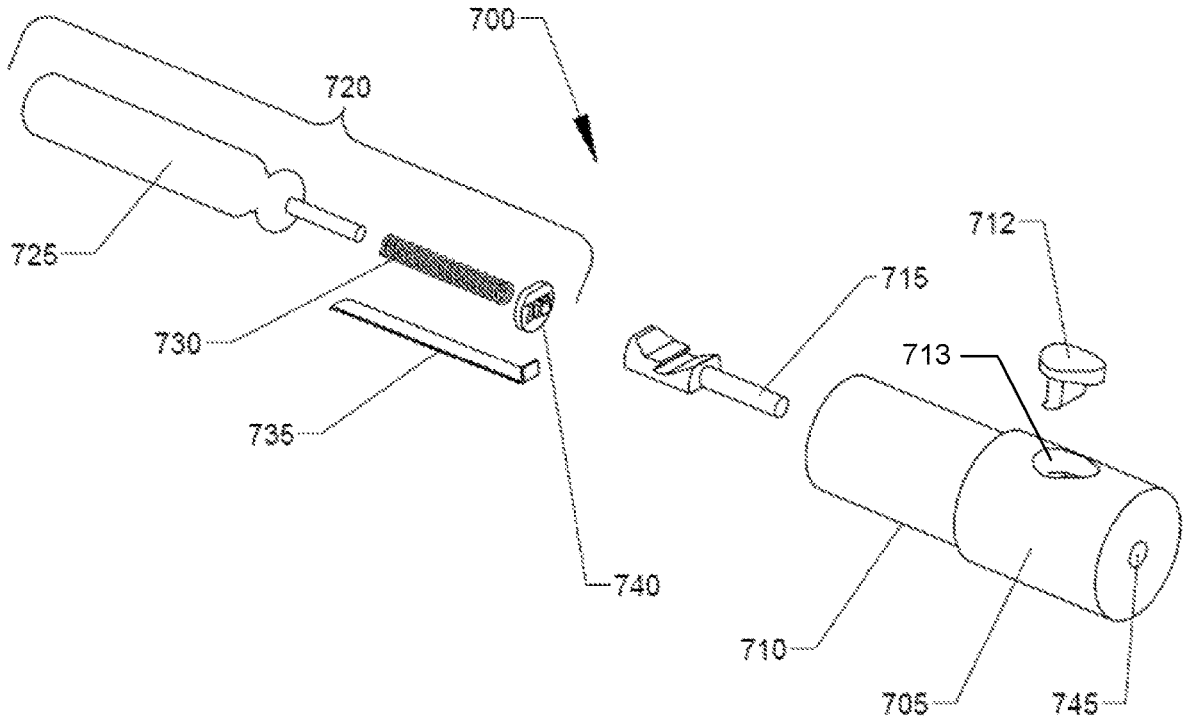

FIG. 7 is an exploded side perspective of a lighted bolt end device, in accordance with some embodiments.

Figure 8:
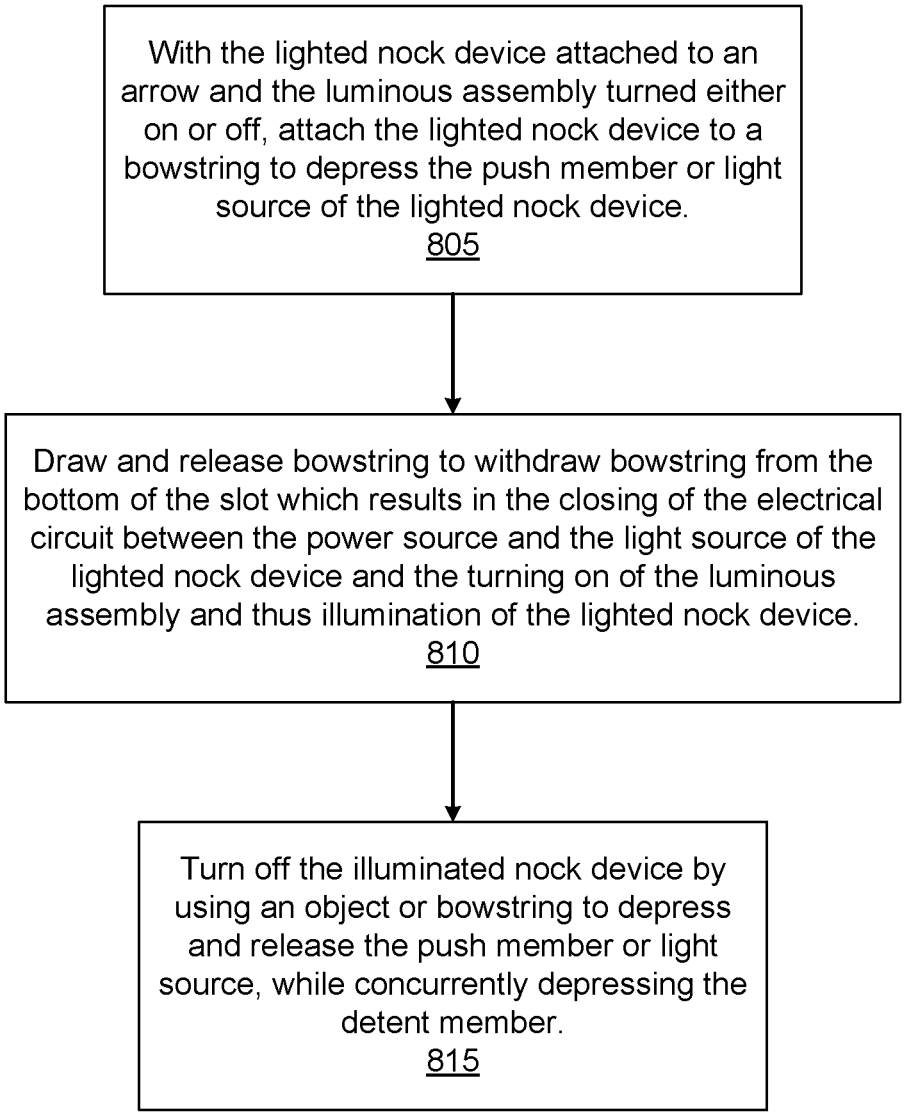

FIG. 8 is a flowchart illustrating a method for using a lighted nock device, in accordance with some embodiments.

Figure 9:
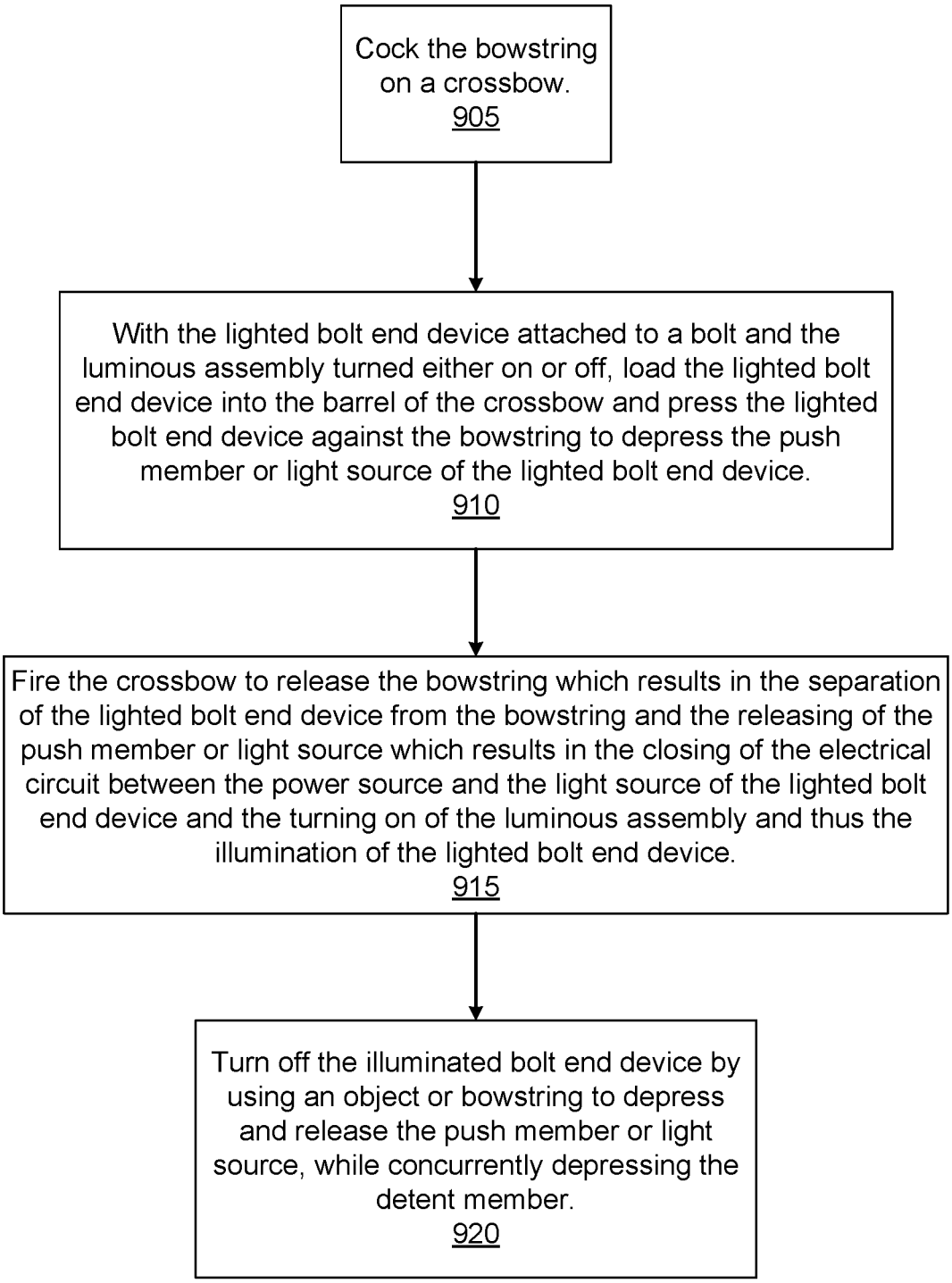

FIG. 9 is a flowchart illustrating a method for using a lighted bolt end device, in accordance with some embodiments.

While the invention is subject to various modifications and alternative forms, specific embodiments thereof are shown by way of example in the drawings and the accompanying detailed description. It should be understood, however, that the drawings and detailed description are not intended to limit the invention to the particular embodiments. This disclosure is instead intended to cover all modifications, equivalents, and alternatives falling within the scope of the present invention as defined by the appended claims.

V. DETAILED DESCRIPTION

One or more embodiments of the invention are described below. It should be noted that these and any other embodiments are exemplary and are intended to be illustrative of the invention rather than limiting. While the invention is widely applicable to different types of systems, it is impossible to include all of the possible embodiments and contexts of the invention in this disclosure. Upon reading this disclosure, many alternative embodiments of the present invention will be apparent to persons of ordinary skill in the art.

A lighted nock device for an arrow allows an archer to be able to more easily see the arrow in flight, see the point of arrow impact, and recover the arrow after a shot. Every archer can benefit from using a lighted nock device. Being able to observe the arrow in flight and see the point of impact helps the archer to diagnose problems with shooting form or bow setup and to make appropriate adjustments. Perhaps more importantly, a lighted nock device allows an archer to recover the arrow.

Bow hunters can especially benefit from using an arrow with a lighted nock device. Recovering an arrow that was shot at an animal is critical in the ethical harvest of animals, and a lighted nock device allows a bow hunter to recover the arrow and animal more easily. Upon recovering the arrow, the bow hunter can diagnose many things about the shot by inspecting the arrow. The presence of blood or other debris on the arrow, or lack thereof, gives many clues as to if the arrow impacted the animal in a desired vital area or not, or if the arrow even hit the animal at all.

U.S. Pat. No. 8,758,177 (177), issued Jun. 24, 2014 to Stuart Minica, is a lighted nock which uses a commercially available light source assembly comprising a battery powered light emitting diode (LED) with an internal single pole switch. The '177 device requires two portions of a nock body to activate the LED; a first portion to receive the bowstring before it is released and a second portion to receive the bowstring after it is released. Having two portions adds to the overall length and weight of the lighted nock device. Additionally, this two portion device adds unnecessary disturbance to the arrow flight due to the nock flight being interrupted on the bowstring as the bowstring transitions from the first portion of the nock body into the second portion of the nock body as the bowstring pushes on the arrow upon release of the bowstring as well as when the bowstring transitions from the second portion of the nock body to and past the first portion of the nock body as the arrow leaves the bowstring. Additionally, the two portion device is more complicated to manufacture than a conventional nock body with only a single portion. The '177 device also utilizes an open hole or reset aperture in the nock to be able to turn off the LED. The open hole allows the user to turn off the LED of the lighted nock device, but the open hole also allows moisture, dust, or other debris such as blood and tissue from animals to enter the nock which can negatively affect its function and reliability.

U.S. Pat. No. 6,123,631, issued on Sep. 26, 2000 to Jeffery Allen Ginder, utilizes a battery-powered LED which is always in the on state unless the arrow is nocked on the bowstring or a special cap is attached to the nock. Such a cap can become easily lost and ultimately render the lighted lock useless since the battery would be drained without this special cap in place. Additionally, in bow hunting situations, when nocking the arrow, the cap would have to be removed and in doing so, the LED would be turned on before being turned off again by the bowstring. This activation of the LED may alert the animal of the presence of the bow hunter and thus possibly ruin the opportunity of the hunt. The use of the special caps also adds to the time it takes for a hunter to nock an arrow to their bow, which is important in cases of making a quick second shot of a target.

The embodiment or embodiments described herein may solve these shortcomings as well as others by proposing a novel illuminated nock device having a single bowstring reception portion with reduced nock body length and weight that will illuminate upon being shot from a bowstring, is more dependable, doesn't require any extra parts, assembly, or preparation work by the user, and is capable of being removed from a bowstring without being illuminated if so desired.

Figure 1:
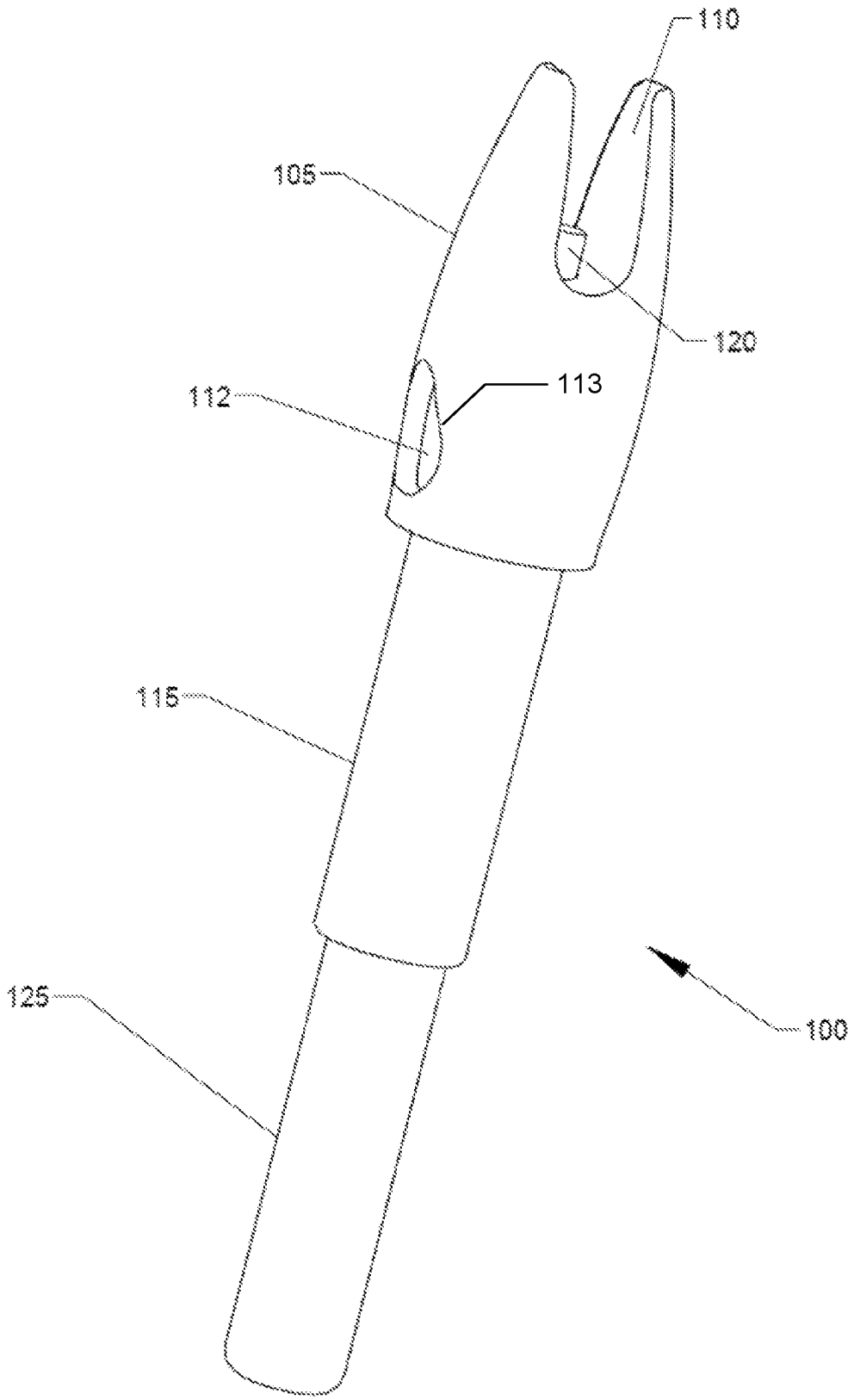
FIG. 1 is a side perspective of a lighted nock device in the "Off" non-illuminated state, in accordance with some embodiments.

FIG. 1 is a side perspective of a lighted nock device in the "Off" non-illuminated state, in accordance with some embodiments.

In some embodiments, the lighted nock device 100 comprises a nock body 105 having a slot 110 for attaching to a bowstring, a detent member 112 retained within a substantially lateral aperture 113 of the nock body for keeping the lighted nock device in the "Off" non-illuminated state when desired, an arrow or shaft attachment portion 115, a push member 120 located at least partially within nock body 105, and a power source 125. A luminous assembly (described in further detail with respect to FIG. 4 and FIG. 7) comprises the power source 125, one or more conducting elements (not shown), and a light source such as an LED (not shown). A portion of the push member 120 protrudes through an opening in the nock body 105 and into the bottom of the slot 110 to allow for placing the lighted nock device into the ready to illuminate state when nocked onto a bowstring. In some embodiments, the light source is configured to also act as the push member 120. The lighted nock device is maintained in the "Off" non-illuminated state by the catching or capturing of a portion of the detent member 112 into a recess of the push member which prevents the electrical circuit between the power source and the light source of the luminous assembly from closing. When a portion of the detent member 112 is caught into the recess of the push member 120, the visible portion of the detent member is depressed into the nock body 105 as illustrated in FIG. 1. The internal workings between the detent member 112 and the push member 120 are shown in more detail in FIG. 6A, FIG. 6B, and FIG. 6C.

In some embodiments, power source 125 is a tubular dry cell battery, such as (but not limited to) a common alkaline, zinc-air, lithium, lithium ion, or other small cell currently known or in use today.

In some embodiments, nock body 105 and arrow or shaft attachment portion 115 are formed of a monolithic piece of rigid material, such as (but not limited to) metal, plastic, polycarbonate, compounds thereof and the like, all of which are well known in the art for their suitability for arrow nock material. Alternatively, nock body 105 may be formed from one or more pieces of rigid material and then joined together via conventional means. Such forming and/or joining may be accomplished through any methods known in the art for producing metal and plastic materials. Accordingly, the method of making the nock body is not further discussed herein.

In some embodiments, detent member 112 is formed of a monolithic piece of rigid material, such as (but not limited to) metal, plastic, polycarbonate, compounds thereof and the like, all of which are well known in the art for their suitability for arrow nock material.

In some embodiments, the arrow or shaft attachment portion 115 is configured to be inserted into an adapter having an inner diameter configured to mate with the outer diameter of the arrow or shaft attachment portion 115. The adapter has an outer diameter larger than the outer diameter of the arrow or shaft attachment portion 115 and is configured to be used as a bushing between the lighted nock device 100 and an arrow with a larger inner diameter than the outer diameter of the arrow or shaft attachment portion 115.

In some embodiments, the luminous assembly may form an integrated package. Various other sources of these components, and alternate arrangements are possible. Although separate power source, light source, and one or more conducting elements are described, those skilled in the art will realize that integrated assemblies of some or all of these components may also be used. Accordingly, the concepts, apparatuses, and techniques described herein are not limited to any particular packaging of these components.

Figure 2:
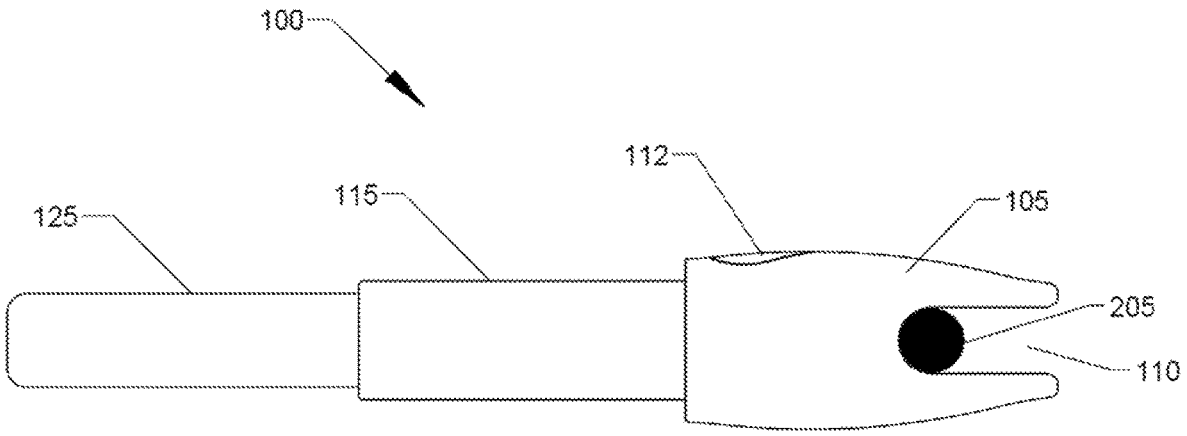
FIG. 2 is a top perspective of a lighted nock device in the nocked, ready to illuminate state, in accordance with some embodiments.

FIG. 2 is a top perspective of a lighted nock device in the nocked, ready to illuminate state, in accordance with some embodiments.

In some embodiments, the lighted nock device 100 comprises the nock body 105 having a slot 110 for attaching to a bowstring 205, a detent member 112 retained within a substantially lateral aperture of the nock body for keeping the lighted nock device in the "Off" non-illuminated state when desired, an arrow or shaft attachment portion 115, and a power source 125. When the lighted nock device 100 is placed or nocked onto the bowstring 205, the bowstring 205 sits fully into the bottom of the slot 110 depressing the push member 120 (shown in FIG. 1) and the light source away from the slot 110 while the electrical circuit between the power source and the light source of the luminous assembly remains in the open position (luminous assembly turned off). When the push member 120 is depressed, the push member 120 forces the detent member 112 out and away from the interior of the nock body 105. When the lighted nock device 100 is shot or removed from the bowstring 205 without depressing the detent member 112, i.e. the withdrawal of the bowstring from the bottom of the slot and the closing of the electrical circuit between the power source and the light source, the luminous assembly is activated, i.e. illuminated as illustrated in FIG. 3.

Figure 3:
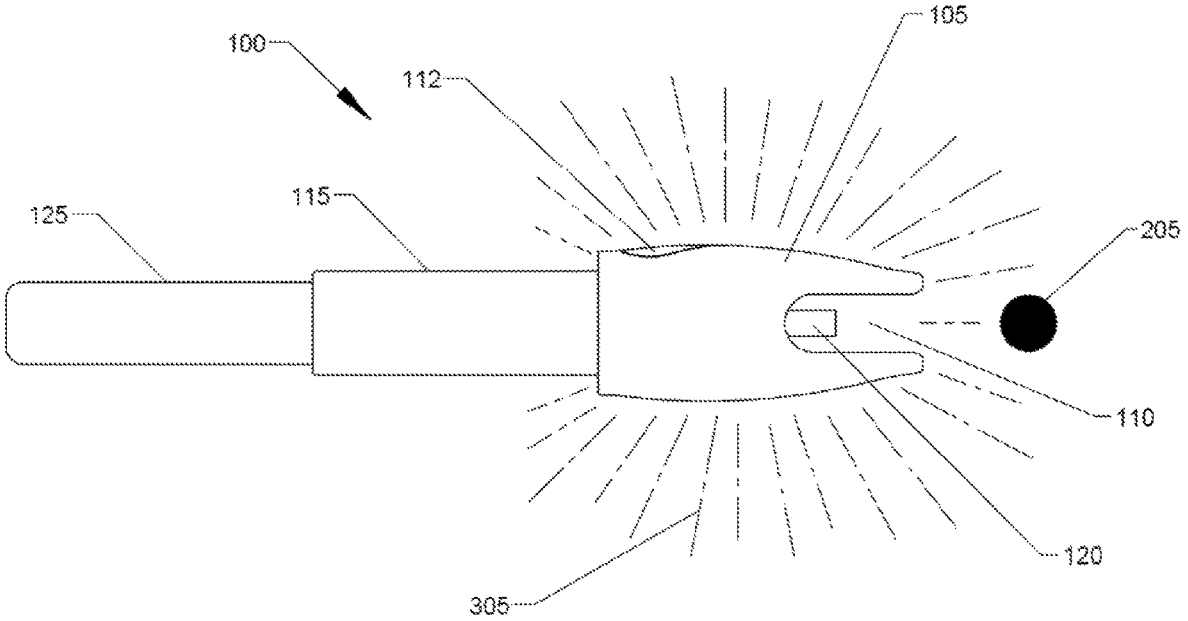
FIG. 3 is a top perspective of a lighted nock device in the "On" illuminated state, in accordance with some embodiments.

FIG. 3 is a top perspective of a lighted nock device in the "On" illuminated state, in accordance with some embodiments.

In some embodiments, the lighted nock device 100 comprises the nock body 105 having a slot 110 for attaching to the bowstring 205, a detent member 112 retained within a substantially lateral aperture of the nock body for keeping the lighted nock device in the "Off" non-illuminated state when desired, an arrow or shaft attachment portion 115, a push member 120 located at least partially within nock body 105, and a power source 125. After withdrawal of the bowstring 205 from the bottom of the slot 110 and the closing of the electrical circuit between the power source and the light source, from either being shot or removed without the depressing of the detent member from the bowstring, the luminous assembly is activated, i.e. turned on. The light 305 emitted from the luminous assembly protrudes through the translucent nock body and also the detent member and the push member if made from a translucent material. The luminous assembly remains on during and after the flight of the arrow until the user desires to turn off the luminous assembly by simply depressing and releasing push member 120 with any slender object of their choosing or even the bowstring, while concurrently depressing the detent member 112. The lighted nock device is ready to be attached to a bowstring, if not already attached, and shot again.

Figure 4:
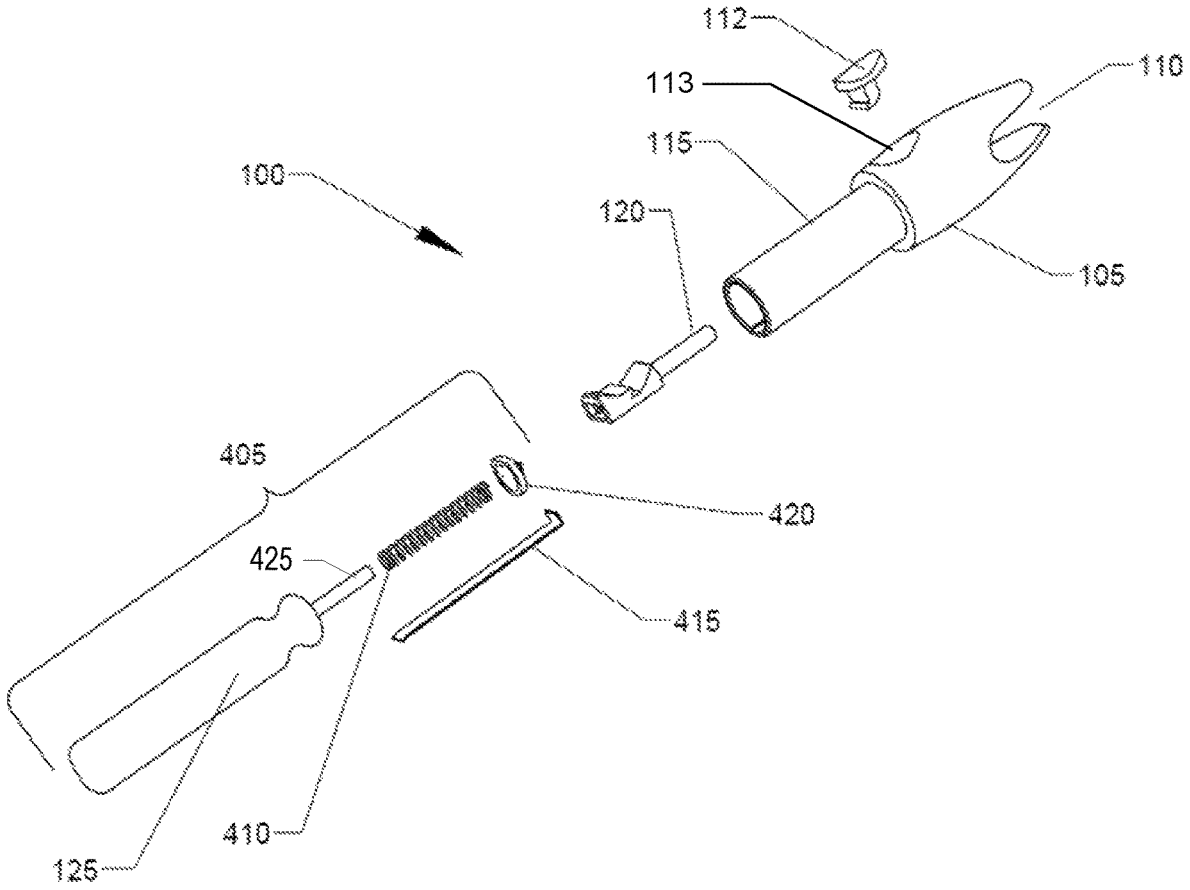
FIG. 4 is an exploded side perspective of a lighted nock device, in accordance with some embodiments.

FIG. 4 is an exploded side perspective of a lighted nock device, in accordance with some embodiments.

In some embodiments, the lighted nock device 100 comprises a nock body 105, a slot 110 for attaching to a bowstring, a detent member 112 retained within a substantially lateral aperture 113 of the nock body for keeping the lighted nock device in the "Off" non-illuminated state when desired, a portion 115 for attaching to an arrow or shaft, a push member 120, and a luminous assembly 405. The luminous assembly 405 comprises a power source 125, a first conducting element 410, a second conducting element 415, and a light source 420. The power source 125 comprises a pin type lithium battery such as the Panasonic BR425. The first conducting element 410 comprises a spring and is connected to the central negative post 425 of the power source 125 and provides electrical continuity to the cathode of the light source 420 as well as force to close the electrical circuit between the anode of the light source 420 and the second conducting element 415. In some embodiments where the spring 410 is non-conducting, a separate conducting member is used to make contact between the negative post of the power source and the cathode of the light source. The second conducting element 415 is used to make electrical contact between the positive outer case of the power source 125 and the anode of the light source 420. The internal workings of some embodiments of the lighted nock device 100 are illustrated in FIG. 6A, FIG. 6B, and FIG. 6C. When fully assembled, a portion of the push member 120 will protrude through the nock body 105 when the luminous assembly 405 is either off or on as shown in FIG. 1 and FIG. 3, respectively. When the luminous assembly is on, the electrical circuit between the power source and the light source is closed and when the luminous assembly is off, the electrical circuit between the power source and the light source is open. A portion of the push member 120 will protrude through the nock body 105 except when attached to a bowstring as shown in FIG. 2.

Although the functionality of light source 420 may, in some exemplary embodiments, be provided by an LED, those skilled in the art will realize that light sources other than LEDs may also be used. Accordingly, the concepts, systems, and techniques described herein are not limited to any particular type of light source.

In an alternate embodiment, the luminous assembly 405 can be reversed or arranged in a different order so that a component other than the push member makes contact with the bowstring when the arrow is nocked. For example, but not by way of limitation, a portion of the light source could protrude into the slot. In such an embodiment, the recess would be part of the light source structure. Furthermore, all or parts of the luminous assembly may be located anywhere within the arrow or the nock body, as long as the receiving and withdrawal of the bowstring from the bottom of the slot and the closing of the electrical circuit between the power source and the light source, either by being shot or removed without the depressing of the detent member, (or any other user selected object that fits into the bottom of the slot) causes the activation of the luminous assembly and if the bowstring (or any other user selected object that fits into the bottom of the slot) is removed from the bottom of the slot while concurrently depressing the detent member, the electrical circuit between the power source and the light source is kept opened to place the luminous assembly in the "Off" state.

FIG. 5 is a top perspective of a lighted nock device in the "On" illuminated state, in accordance with some embodiments.

In some embodiments, the lighted nock device 100 comprises the nock body 105 having a slot 505 for attaching to the bowstring 205, a detent member 112 retained within a substantially lateral aperture of the nock body for keeping the lighted nock device in the "Off" non-illuminated state when desired, an arrow or shaft attachment portion 115, a push member 120 located at least partially within nock body 105, and a power source 125. In this embodiment, the slot 505 comprises a constricted portion 510 configured to retain the bowstring 205 in the bottom of the slot 505 when the arrow is nocked onto the bowstring, i.e. the bottom of the slot has received a bowstring. After withdrawal of the bowstring 205 from the bottom of the slot 505 and the closing of the electrical circuit between the power source and the light source, either by being shot or removed without the depressing of the detent member, the luminous assembly is activated, i.e. turned on. The light 305 emitted from the luminous assembly protrudes through the translucent nock body and also the detent member and push member if made from a translucent material. The luminous assembly remains on during and after the flight of the arrow until the user desires to turn off the luminous assembly by simply depressing and releasing push member 120 with any slender object of their choosing or even the bowstring, while concurrently depressing the detent member. The lighted nock device is ready to be attached to a bowstring, if not already attached, and shot again.

FIG. 6A, FIG. 6B, and FIG. 6C are cross-sectional, side perspectives of the lighted nock device of FIG. 5 in the "Off," nocked, and "On" states, respectively, in accordance with some embodiments.

In some embodiments, the lighted nock device 100 comprises the nock body 105, having a slot 505, with a constricted portion 510, for attaching to a bowstring 205, a detent member 112 retained within a substantially lateral aperture 113 of the nock body for keeping the lighted nock device in the "Off" non-illuminated state when desired, an arrow or shaft attachment portion 115, a push member 120 located at least partially within nock body 105 and having a portion of the push member protruding through an opening 645 in the nock body, a power source 125, a first conducting element 410, a second conducting element 415, and a light source 420. In the embodiment illustrated in FIG. 6A, the lighted nock is in the "Off" state since a portion of the detent member 112 is caught or captured into a recess 605 of the push member 120 such that the force from the first conducting member 410 is not able to close the electrical circuit between the light source and the power source. In the embodiment illustrated in FIG. 6B, the lighted nock device 100 is placed or nocked onto the bowstring 205 resulting in the compression of the first conducting member 410 and the release of the portion of the detent member 112 from the recess 605 of the push member 120. In the embodiment illustrated in FIG. 6C, the bowstring is withdrawn from the bottom of the slot and the force from the first conducting member causes the electrical circuit between the power source and the light source to be closed to activate the luminous assembly. While in the "On" state, merely pressing on the detent member will not place the lighted nock in the "Off" state, i.e. turn off the lighted nock device. In order to turn off the lighted nock device, any slender object or even the bowstring is inserted to the bottom of the slot and then released while concurrently depressing the detent member, resulting in the catching of a portion of the detent member into the recess of the push member as illustrated in FIG. 6A.

FIG. 7 is an exploded side perspective of a lighted bolt end device, in accordance with some embodiments.

In some embodiments, the lighted nock device may be configured for use on a crossbow. In such an embodiment, the lighted bolt end device 700 comprises a bolt end body 705, a portion 710 for attaching to a bolt or shaft, a detent member 712 retained within a substantially lateral aperture 713 of the bolt end body for keeping the lighted bolt end device in the "Off" non-illuminated state when desired, a push member 715, and a luminous assembly 720. The luminous assembly 720 comprises a power source 725, a first conducting element 730, a second conducting element 735, and a light source 740. The internal workings of some embodiments of the mechanism for placing the lighted bolt end device in the "Off," nocked, and "On" states with the detent member are illustrated in FIG. 6A, FIG. 6B, and FIG. 6C, respectively. When fully assembled and in the open position (luminous assembly turned off), a portion of the push member 715 protrudes through an opening 745 on the face of the bolt end body 705 opposite the portion 710 for attaching to a bolt or shaft. A portion of the push member 715 will protrude through the bolt end body 705 except when the bolt end body abuts against a bowstring or other object.

In some embodiments, the bolt or shaft attachment portion 710 is configured to be inserted into an adapter having an inner diameter configured to mate with the outer diameter of the bolt or shaft attachment portion 710. The adapter has an outer diameter larger than the outer diameter of the bolt or shaft attachment portion 710 and is configured to be used as a bushing between the lighted bolt end device 700 and a bolt with a larger inner diameter than the outer diameter of the bolt or shaft attachment portion 710.

In an alternate embodiment, the luminous assembly 720 can be reversed or arranged in a different order so that a component other than the push member makes contact with the bowstring when the push member is pressed down. For example, but not by way of limitation, a portion of the light source could protrude through the opening on the face of the bolt end body. In such an embodiment, the recess would be part of the light source structure. Furthermore, all or parts of the luminous assembly may be located anywhere within the bolt or the bolt end body, as long as the abutting and separation of the bowstring (or any other user selected object) from the push member or light source and the closing of the electrical circuit between the power source and the light source, either by being shot or separated without the depressing of the detent member, causes the activation of the luminous assembly and if the bowstring (or any other user selected object) is separated from the push member or light source while concurrently depressing the detent member, the electrical circuit between the power source and the light source is kept opened to place the luminous assembly in the "Off" state.

In some embodiments, the luminous assembly illustrated and described in FIG. 1, FIG. 2, FIG. 3, FIG. 4, FIG. 5, FIG. 6A, FIG. 6B, FIG. 6C, and FIG. 7 may comprise a light source which strobes on and off or strobes between different colors when activated. Additionally, the strobing of the light source may be configured such that the strobing does not commence until after a delay, such as a few seconds, has elapsed after the activation of the luminous assembly. This delay in the activation of the strobing allows for an easier tracking of the arrow during flight and a facilitated location during recovery of the arrow.

In some embodiments, the luminous assembly illustrated and described in FIG. 1, FIG. 2, FIG. 3, FIG. 4, FIG. 5, FIG. 6A, FIG. 6B, FIG. 6C, and FIG. 7 may be used in other sports and entertainment products such as for badminton shuttlecocks, fishing bobs and lures, flying discs, boomerangs, golf balls, and the like.

FIG. 8 is a flowchart illustrating a method for using a lighted nock device, in accordance with some embodiments. In some embodiments, the method illustrated in FIG. 8 may be performed by one or more of the devices illustrated in FIG. 1, FIG. 2, FIG. 3, FIG. 4, FIG. 5, FIG. 6A, FIG. 6B, and FIG. 6C.

According to one embodiment of the present invention, the method begins at block 805, where, with the lighted nock device attached to an arrow and the luminous assembly turned either on or off, the lighted nock device is attached to a bowstring, i.e. the slot of the lighted nock device receives the bowstring, in order to depress the push member or light source of the lighted nock device which opens the electrical circuit between the power source and the light source. At block 810, the bow is drawn and the bowstring is released, ultimately resulting in the withdrawal of the bowstring from the bottom of the slot which results in the closing of the electrical circuit between the power source and the light source of the lighted nock device and the turning on of the luminous assembly and thus illumination of the lighted nock device. The archer can now see the light emitted from the lighted nock device allowing the archer to be able to more easily see the arrow during flight, see the point of arrow impact, and recover the arrow after the shot. The electrical circuit between the power source and the light source is maintained in the closed position (light source activated) until the archer desires to turn off the light source. After the arrow has been recovered, at block 815, the lighted nock device may be turned off by depressing and releasing the push member or light source with an object or the bowstring, while concurrently depressing the detent member. The archer can now reuse the lighted nock device.

FIG. 9 is a flowchart illustrating a method for using a lighted bolt end device, in accordance with some embodiments. In some embodiments, the method illustrated in FIG. 9 may be performed by one or more of the devices illustrated in FIG. 6A, FIG. 6B, FIG. 6C, and FIG. 7.

According to one embodiment of the present invention, the method begins at block 905, where a bowstring of a crossbow is cocked. At block 910, with a lighted bolt end device attached to a bolt and the luminous assembly turned either on or off, the lighted bolt end device is loaded into the barrel of the crossbow and pressed against the bowstring in order to depress the push member or light source of the lighted bolt end device which opens the electrical circuit between the power source and the light source. At block 915, the crossbow is fired to release the bowstring, ultimately resulting in the separation of the lighted bolt end device from the bowstring and the releasing of the push member or light source which results in the closing of the electrical circuit between the power source and the light source of the lighted bolt end device and the turning on of the luminous assembly and thus illumination of the lighted bolt end device. The archer can now see the light emitted from the lighted bolt end device allowing the archer to be able to more easily see the bolt during flight, see the point of bolt impact, and recover the bolt after the shot. The switch is maintained in the closed position (light source activated) until the archer desires to turn off the light source. After the bolt has been recovered, at block 920, the lighted bolt end device may be turned off by depressing and releasing the push member or light source with any object, even the bowstring, while concurrently depressing the detent member. The archer can now reuse the lighted bolt end device. Although the flowchart may describe the operations as a sequential process, the operations of block 905 and block 910 can be performed in parallel or concurrently. In addition, the order of the operations of block 905 and block 910 may be rearranged.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The benefits and advantages that may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions, and improvements to the embodiments described above are possible. It is contemplated that these variations, modifications, additions, and improvements fall within the scope of the invention as detailed within the following claims.

The invention claimed is:

1. A lighted nock comprising:
a nock body comprising:
an arrow or shaft attachment portion; and
a proximate end having a slot adapted to receive a bowstring;
a detent member at least partially disposed within the nock body;
a luminous assembly at least partially disposed within the nock body; and
a push member at least partially disposed within the nock body, wherein the push member comprises a recess and at least a portion of the push member protrudes into the proximate end;
wherein the luminous assembly is not activated when at least a portion of the detent member is captured within the recess of the push member,
wherein the push member is configured to force the detent member out of the recess upon depression of the push member, and
wherein the luminous assembly is activated when the push member is not depressed.

2. The lighted nock of claim 1, wherein the luminous assembly is activated when the bowstring is withdrawn from the slot.

3. The lighted nock of claim 1, wherein the luminous assembly comprises:
a power source;
a first conducting element;
a second conducting element; and
a light source.

4. The lighted nock of claim 3, wherein the first conducting element comprises a spring.

5. The lighted nock of claim 3, wherein the light source is strobed.

6. The lighted nock of claim 1, wherein the slot comprises:
a bottom; and
a constricted portion;
wherein the bottom is adapted to receive the bowstring and wherein the constricted portion is configured to retain the bowstring in the bottom of the slot.

7. The lighted nock of claim 1, further comprising an adapter comprising an inner diameter and an outer diameter, wherein the inner diameter is configured to mate with the arrow or shaft attachment portion of the nock body and wherein the outer diameter is configured to mate with an arrow or shaft.

8. A lighted nock comprising:
a nock body comprising:
an arrow or shaft attachment portion; and
a proximate end having a slot adapted to receive a bowstring;
a detent member at least partially disposed within the nock body; and
a luminous assembly at least partially disposed within the nock body, wherein the luminous assembly comprises:
a power source; and
a light source;
wherein the light source comprises a recess and at least a portion of the light source protrudes into the proximate end,
wherein the luminous assembly is not activated when at least a portion of the detent number is captured within the recess of the light source,
wherein the light source is configured to force the detent member out of the recess upon depression of the light source, and
wherein the luminous assembly is activated when the light source is not depressed.

9. The lighted nock of claim 8, wherein the luminous assembly is activated when the bowstring is withdrawn from the slot.

10. The lighted nock of claim 8, wherein the luminous assembly further comprises a first conducting element and a second conducting element.

11. The lighted nock of claim 10, wherein the first conducting element comprises a spring.

12. The lighted nock of claim 8, wherein the light source is strobed.

13. The lighted nock of claim 8, wherein the slot comprises:
a bottom; and
a constricted portion;
wherein the bottom is adapted to receive the bowstring and wherein the constricted portion is configured to retain the bowstring in the bottom of the slot.

14. The lighted nock of claim 8, further comprising an adapter comprising an inner diameter and an outer diameter, wherein the inner diameter is configured to mate with the arrow or shaft attachment portion of the nock body and wherein the outer diameter is configured to mate with an arrow or shaft.

15. A lighted bolt end comprising:
a bolt end body comprising:
a bolt or shaft attachment portion; and
a proximate end adapted to abut a bowstring;
a detent member at least partially disposed within the bolt end body;
a luminous assembly at least partially disposed within the bolt end body; and
a push member at least partially disposed within the bolt end body, wherein the push member comprises a recess and at least a portion of the push member protrudes from the proximate end,
wherein the luminous assembly is not activated when at least a portion of the detent member is captured within the recess of the push member;
wherein the push member is configured to force the detent member out of the recess upon depression of the push member, and
wherein the luminous assembly is activated when the push member is not depressed.

16. The lighted bolt end of claim 15, wherein the luminous assembly is activated when the bowstring is separated from the proximate end of the bolt end body.

17. The lighted bolt end of claim 15, wherein the luminous assembly comprises:
a power source;
a first conducting element;
a second conducting element; and
a light source.

18. The lighted bolt end of claim 17, wherein the first conducting element comprises a spring.

19. The lighted bolt end of claim 17, wherein the light source is strobed.

20. The lighted bolt end of claim 15, further comprising an adapter comprising an inner diameter and an outer diameter, wherein the inner diameter is configured to mate with the bolt or shaft attachment portion of the bolt end body and wherein the outer diameter is configured to mate with a bolt or shaft.

21. A lighted bolt end comprising:

a bolt end body comprising:

a bolt or shaft attachment portion; and a proximate end adapted to abut a bowstring;

a detent member at least partially disposed within the bolt end body; and a luminous assembly at least partially disposed within the bolt end body, wherein the luminous assembly comprises:

a power source; and a light source;

wherein the light source comprises a recess and at least a portion of the light source protrudes from the proximate end, wherein the luminous assembly is not activated when at least a portion of the detent member is captured within the recess of the light source;

wherein the light source is configured to force the detent member out of the recess upon depression of the light source, and wherein the luminous assembly is activated when the light source is not depressed.

22. The lighted bolt end of claim 21, wherein the luminous assembly is activated when the bowstring is separated from the proximate end of the bolt end body.

23. The lighted bolt end of claim 21, wherein the luminous assembly further comprises a first conducting element and a second conducting element.

24. The lighted bolt end of claim 23, wherein the first conducting element comprises a spring.

25. The lighted bolt end of claim 21, wherein the light source is strobed.

26. The lighted bolt end of claim 21, further comprising an adapter comprising an inner diameter and an outer diameter, wherein the inner diameter is configured to mate with the bolt or shaft attachment portion of the bolt end body and wherein the outer diameter is configured to mate with a bolt or shaft.

* * * * *